US011114006B2

(12) United States Patent
Huang

(10) Patent No.: US 11,114,006 B2
(45) Date of Patent: Sep. 7, 2021

(54) DISPLAY DEVICE, DRIVE METHOD THEREFOR, AND DRIVE SYSTEM THEREFOR

(71) Applicant: HKC CORPORATION LIMITED, Guangdong (CN)

(72) Inventor: Beizhou Huang, Guangdong (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 16/756,891

(22) PCT Filed: Mar. 13, 2018

(86) PCT No.: PCT/CN2018/078856
§ 371 (c)(1),
(2) Date: Apr. 17, 2020

(87) PCT Pub. No.: WO2019/080437
PCT Pub. Date: May 2, 2019

(65) Prior Publication Data

US 2021/0201728 A1 Jul. 1, 2021

(30) Foreign Application Priority Data

Oct. 24, 2017 (CN) ..... 201711000509.6

(51) Int. Cl.
*G09G 3/20* (2006.01)

(52) U.S. Cl.
CPC ..... *G09G 3/20* (2013.01); *G09G 2310/08* (2013.01); *G09G 2330/06* (2013.01)

(58) Field of Classification Search
None
See application file for complete search history.

(56) References Cited

U.S. PATENT DOCUMENTS 8,831,064 B1 * 9/2014 Kaviani ..... H04B 15/04 375/134
2004/0263427 A1 12/2004 Horigan
2015/0340013 A1 * 11/2015 Lee ..... G09G 5/18 345/213

FOREIGN PATENT DOCUMENTS

CN 101958091 A 1/2011
CN 102456328 A 5/2012
(Continued)

OTHER PUBLICATIONS

International Search Report, dated Jun. 27, 2018, for HKC Corporation Limited et al., International Application No. PCT/CN2018/078856, Filed Mar. 13, 2018.
(Continued)

*Primary Examiner* — Christopher J Kohlman
(74) *Attorney, Agent, or Firm* — Law Offices of Albert Wai-Kit Chan, PLLC

(57) ABSTRACT

A display device, a drive method therefor, and a drive system therefor are provided by embodiments of the present application. The drive method includes: detecting whether a spectrum of a drive signal is spread when the drive signal is received, and the drive signal is configured to drive the display panel; outputting a clock signal output from the control module to the source drive module if the spectrum of the drive signal is spread; performing spectrum spread on the clock signal according to a preset spread spectrum ratio if the spectrum of the drive signal is not spread; and outputting the clock signal with the spread spectrum to the source drive module.

18 Claims, 4 Drawing Sheets

(56) References Cited

FOREIGN PATENT DOCUMENTS

| | | | |
|---|---|---|---|
| CN | 104021758 | A | 9/2014 |
| CN | 104933984 | A | 9/2015 |
| CN | 205451752 | U | 8/2016 |
| CN | 106205460 | A | 12/2016 |
| CN | 106409223 | A | 2/2017 |
| CN | 106972896 | A | 7/2017 |
| CN | 107154243 | A | 9/2017 |
| CN | 107665661 | A | 2/2018 |
| KR | 20110077424 | A | 7/2011 |

OTHER PUBLICATIONS

Written Opinion, dated Jun. 27, 2018, for HKC Corporation Limited et al., International Application No. PCT/CN2018/078856, Filed Mar. 13, 2018.

Chinese Office Action, dated May 29, 2019, for HKC Corporation Limited et al., Chinese Application No. 201711000509.6, filed Oct. 24, 2017.

* cited by examiner

DISPLAY DEVICE, DRIVE METHOD THEREFOR, AND DRIVE SYSTEM THEREFOR

CROSS-REFERENCE TO RELATED APPLICATIONS

The present disclosure is a National Stage of International Patent Application with No. PCT/CN201.8/078856 filed on Mar. 13, 2016, which claims priority to Chinese Patent Application No. 201711000509.6 filed on Oct. 24, 2017, which is hereby incorporated by reference in its entirety.

TECHNICAL FIELD

Embodiments of the present application relates to the technical field of display, and more particularly relates to a display device, a drive method therefor, and a drive system therefor.

BACKGROUND

With the continuous development of display techniques, display devices such as liquid crystal panels and displays continue to develop in the direction of thinness, large-screen, low-power, and low-cost. In detection processes during actual display product development, it is required by regulations that tests of electromagnetic interference are needed, so as to prevent adverse effects of display products on surrounding objects and human bodies. An essence of the electromagnetic interference test is to detect an energy value radiated by a product at each frequency band. Because components of the display product operate at several fixed frequencies, if the electromagnetic interference is detected to have an energy value radiated at a certain frequency band exceeded, spread spectrum setting is required.

However, at present, in order to improve the electromagnetic interference condition of the display product, a clock signal output from a control module of the display product may be performed with spread spectrum, or a drive signal output from the control module may be performed with the spread spectrum, when the spectrum of the clock signal and the spectrum of the drive signal are both spread and result in that an actual spread spectrum exceeds an expected value, a source drive module may be unable to normally receive data and an abnormal display picture may be resulted.

SUMMARY

A display device, a drive method therefor, and a drive system therefor are provided by embodiments of the present application, aiming at solving the problem that recently, in order to improve the electromagnetic interference of the display product, the clock signal output from the control module of the display product may be performed with spread spectrum, or the drive signal output from the control module may be performed with the spread spectrum, when the spectrum of the clock signal and the spectrum of the drive signal are both spread and result in that the actual spread spectrum exceeds the expected value, the source drive module may be unable to normally receive data and the abnormal display picture may be resulted.

Embodiments of the present application provide a drive method for a display device. The display device includes: a control module, a source drive module, and a display panel. The drive method includes:

detecting whether a spectrum of a drive signal is spread when the drive signal is received, and the drive signal is configured to drive the display panel;

outputting a clock signal output from the control module to the source drive module if the spectrum of the drive signal is spread;

performing spectrum spread on the clock signal according to a preset spread spectrum ratio if the spectrum of the drive signal is not spread; and outputting the clock signal with the spread spectrum to the source drive module.

In one embodiment, the preset spread spectrum ratio ranges between 2% and 5%.

In one embodiment, the step of detecting whether the spectrum of the drive signal is spread includes:

detecting whether a frequency of the drive signal is consistent with a frequency of a preset drive signal;

determining that the spectrum of the drive signal is not spread if the frequency of the drive signal is consistent with the frequency of the preset drive signal; and determining that the spectrum of the drive signal is spread if the frequency of the drive signal is not consistent with the frequency of the preset drive signal.

In one embodiment, the step of detecting whether the frequency of the drive signal is consistent with the frequency of the preset drive signal includes:

detecting whether a variation rate of the frequency of the drive signal relative to the frequency of the preset drive signal is greater than a preset threshold value;

determining that the drive signal is not consistent with the frequency of the preset drive signal if the variation rate is greater than the preset threshold value; and determining that the drive signal is consistent with the frequency of the preset drive signal if the variation rate is smaller than or equal to the preset threshold value.

In one embodiment, the preset threshold value ranges between 2% and 5%.

In one embodiment, before outputting the clock signal output from the control module to the source drive module, the drive method further includes:

detecting a spread spectrum ratio of the drive signal;

entering the operation of outputting the clock signal output from the control module to the source drive module if the spread spectrum ratio is smaller or equal to the preset threshold value; and sending a prompt signal if the spread spectrum ratio is greater than the preset threshold value.

In one embodiment, the preset threshold value ranges between 2% and 5%.

In one embodiment, the step of detecting whether the spectrum of the drive signal is spread includes:

detecting whether the drive signal is a variable frequency signal;

determining the spectrum of the drive signal is not spread if the drive signal is a constant frequency signal; and determining the spectrum of the drive signal is spread if the drive signal is a variable frequency signal.

In one embodiment, the control module is connected with the source drive module, the source drive module is connected with the display panel, the control module is a display drive board, the source drive module is a film source drive chip, the display panel is one selected from the group consisting of a thin film transistor liquid crystal display, an electro luminescence display, and a quantum dot light emitting diode display panel.

Embodiments of the present application further provide a drive system for a display device. The display device includes: a control module, a source drive module, and a display panel. The drive system includes:

a spread spectrum detection module, configured to detect whether a spectrum of a drive signal is spread when the drive signal is received, and the drive signal is configured to drive the display panel;

a spread spectrum determination module, configured to output a clock signal output from the control module to the source drive module if the spectrum of the drive signal is spread;

a spread spectrum module, configured to perform spectrum spread on the clock signal according to a preset spread spectrum ratio if the spectrum of the drive signal is not spread; and a data output module, configured to output the clock signal with the spread spectrum to the source drive module.

In one embodiment, the preset spread spectrum ratio ranges between 2% and 5%.

In one embodiment, the spread spectrum detection module includes:

a first spread spectrum detection unit, configured to detect whether a frequency of the drive signal is consistent with a frequency of a preset drive signal;

a first determination unit, configured to determine that the spectrum of the drive signal is not spread if the frequency of the drive signal is consistent with the frequency of the preset drive signal; and a second determination unit, configured to determine that the spectrum of the drive signal is spread if the frequency of the drive signal is not consistent with the frequency of the preset drive signal.

In one embodiment, the first spread spectrum detection unit is configured to:

detect whether a variation rate of the frequency of the drive signal relative to the frequency of the preset drive signal is greater than a preset threshold value;

determine that the drive signal is not consistent with the frequency of the preset drive signal if the variation rate is greater than the preset threshold value; and determine that the drive signal is consistent with the frequency of the preset drive signal if the variation rate is smaller than or equal to the preset threshold value.

In one embodiment, the preset threshold value ranges between 2% and 5%.

In one embodiment, the spread spectrum detection module includes:

a second spread spectrum detection unit, configured to detect a spread spectrum ratio of the drive signal;

a data output unit, configured to enter the operation of outputting the clock signal output from the control module to the source drive module if the spread spectrum ratio is smaller or equal to the preset threshold value;

a prompt unit, configured to send a prompt signal if the spread spectrum ratio is greater than the preset threshold value.

In one embodiment, the preset threshold value ranges between 2% and 5%.

In one embodiment, the spread spectrum detection module includes:

a third spread spectrum detection unit, configured to detect whether the drive signal is a variable frequency signal;

a third determination unit, configured to determine the spectrum of the drive signal is not spread if the drive signal is a constant frequency signal; and a fourth determination unit, configured to determine the spectrum of the drive signal is spread if the drive signal is a variable frequency signal.

In one embodiment, the control module is connected with the source drive module, the source drive module is connected with the display panel, the control module is a display drive board, the source drive module is a film source drive chip, the display panel is any one selected from the group consisting of a thin film transistor liquid crystal display, an electro luminescence display, and a quantum dot light emitting diode display panel.

Embodiments of the present application further provide a drive method for a display device. The display device includes: a control module, a source drive module, and a display panel. The drive method includes:

detecting whether a drive signal is a variable frequency signal when the drive signal is received, and the drive signal is configured to drive the display panel;

outputting a clock signal output from the control module to the source drive module if the drive signal is a constant frequency signal;

performing spectrum spread on the clock signal according to a preset spread spectrum ratio if the drive signal is a variable frequency signal; and outputting the clock signal with the spread spectrum to the source drive module.

In one embodiment, the control module is connected with the source drive module, the source drive module is connected with the display panel, the control module is a display drive board, the source drive module is a film source drive chip, the display panel is any one selected from the group consisting of a thin film transistor liquid crystal display, an electro luminescence display, and a quantum dot light emitting diode display panel.

In embodiments of the present application, it is detected whether the spectrum of the drive signal is spread when the drive signal is received; if yes, the clock signal output from the control module is output to the source drive module; if no, the spectrum of the clock signal is spread according to the preset spread spectrum ratio and then output to the source drive module, thus, the electromagnetic interference of the display device can be effectively reduced, as well as the normal display picture of the display panel can be ensured.

BRIEF DESCRIPTION OF THE DRAWINGS

In order to more clearly illustrate the technical solution in embodiments of the present application, the following drawings, which are to be used in the description of the embodiments or the prior art, will be briefly described. It will be apparent that the drawings described in the following description are merely embodiments of the present application. Other drawings may be obtained by those skilled in the art without paying creative labor.

DETAILED DESCRIPTION OF EMBODIMENTS

In order to make those skilled in the art better understood the technical solutions of the present application, technical solutions in embodiments of the present application are clearly described hereinbelow with reference to accompanying drawings in the embodiments of the present application. Obviously, the described embodiments are only a part of embodiments of the present application, rather than all the embodiments. All other embodiments obtained by those skilled in the art based on the embodiments of the present application without creative efforts shall fall within the protection scope of the present application.

Terms "comprising" and variations thereof in description, claims, and the drawings of the present application are intended to cover non-exclusive inclusion. For example, a process, a method, a system, a product, or a device that includes a series of steps or units is not limited to the steps or the units listed, but may optionally include steps or units not listed, or may optionally include other inherent steps or units for the process, the method, the product, or the device. In addition, terms "first", "second", "third", and the like are used to distinguish different objects, rather than to describe a particular order.

Figure 1:
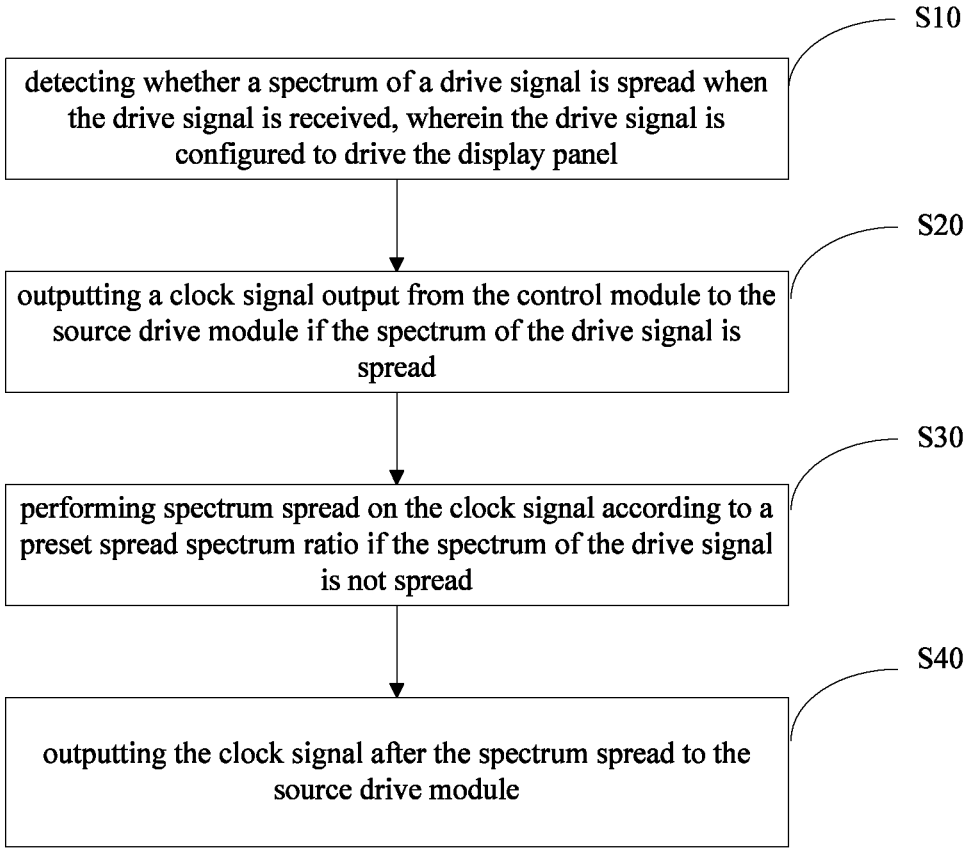
FIG. 1 is a flow chart of a drive method for a display device provided by one embodiment of the present application.

As shown in FIG. 1, a drive method for a display device provided by one embodiment of the present application is applicable to a display device, and the display device includes: a control module, a source drive module, and a display panel. The control module is connected with the source drive module, and the source drive module is connected with the display panel.

In application, the control module includes those can be implemented by integrated circuits, such as a central processing unit (CPU) or an application specific integrated circuit (ASIC). The control module may also be a display drive board of the display device.

In application, the source drive module may be any device or circuit having a function of performing data drive on pixels of the display panel, for example, a source drive chip, a film source drive chip, etc.

In application, the display panel may be any type of the display panel, for example, a crystal display panel based on thin film transistor liquid crystal display (LFT-LCD) technique, a crystal display panel based on liquid crystal display (LCD) technique, an electro luminescence display based on organic electro luminescence display technique, a quantum dot light emitting diode display panel based on quantum dot light emitting diode technique, or a curved display panel.

The drive method includes:

S10: detecting whether a spectrum of a drive signal is spread when the drive signal is received, and the drive signal is configured to drive the display panel;

In application, spread spectrum refer to convert a normal signal of a fixed frequency output from the control module into a variable frequency signal having a frequency positively and negatively fluctuating around the normal signal, thereby distributing an electromagnetic interference energy of the normal signal on the original frequency band to a frequency band adjacent to the original frequency band. Generally, the spread spectrum ratio adopts a ratio of a maximum variation of the original frequency of the variable frequency signal relative to the original frequency of the normal frequency to the original frequency as a measurement unit. The larger the spread spectrum ratio is, the larger the frequency variation is. Generally, the spread spectrum ratio cannot exceed a certain threshold value, or otherwise, the source drive module may be unable to normally receive the clock signal and the drive signal, resulting in abnormal display picture.

In application, the determination whether the spectrum of the drive signal is spread can be realized by means of detecting whether the drive signal is the variable frequency signal, or by means of detecting whether the variation rate of the frequency of the drive signal relative to a frequency of a preset normal drive signal is greater than the preset threshold value, if yes, then the spectrum of the drive signal is spread. The preset threshold value ranges between 2% and 5%, for example, may be 2%, 3%, 4%, or 5%.

Figure 2:
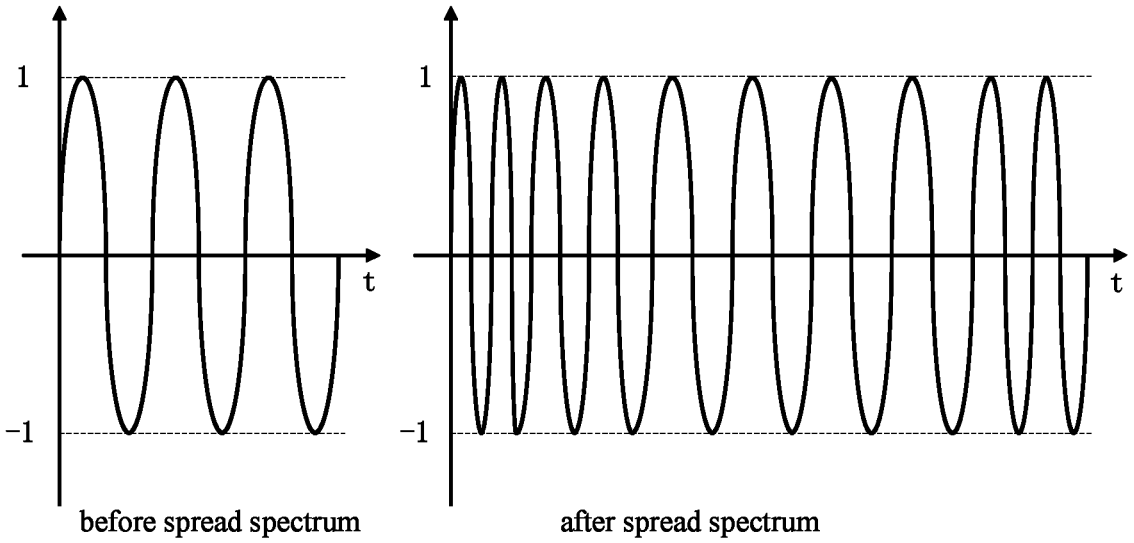
FIG. 2 is a waveform schematic diagram for a drive signal before and after spread spectrum provided by one embodiment of the present application.

As shown in FIG. 2, a waveform schematic diagram of the drive signal before and after the spread spectrum is exemplarily shown, in which, the drive signal before spread spectrum is a periodic signal with a fixed frequency, and the drive signal after spread spectrum has positive and negative fluctuation variations.

The drive method further includes:

S20: outputting a clock signal output from the control module to the source drive module if the spectrum of the drive signal is spread.

S30: performing spectrum spread on the clock signal according to a preset spread spectrum ratio if the spectrum of the drive signal is not spread.

In one embodiment, the preset spread spectrum ratio can be any value ranging between 2% and 5%, for example, may be 2%, 3%, 4%, or 5%.

The drive method further includes:

S40: outputting the clock signal with the spread spectrum to the source drive module.

In application, the drive method can be executed by the control module of the display device, and each step of the drive method can be a step of a software program executed by the control module.

In this embodiment, it is detected whether the spectrum of the drive signal is spread when the drive signal is received; if yes, the clock signal output from the control module is output to the source drive module; if no, the spectrum of the clock signal is spread according to the preset spread spectrum ratio and then output to the source drive module, thus, the electromagnetic interference of the display device can be effectively reduced, as well as the normal display picture of the display panel can be ensured.

Figure 3:
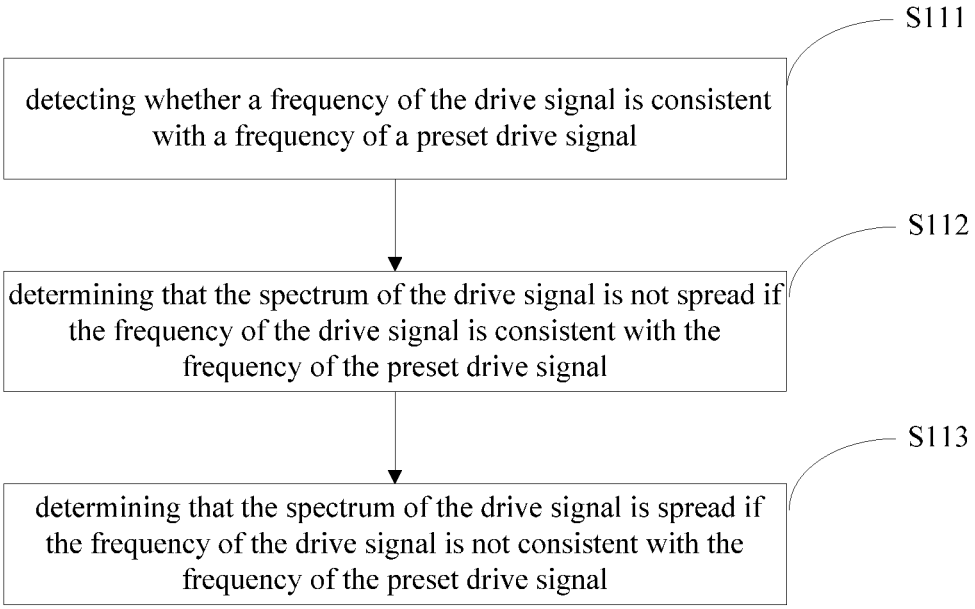
FIG. 3 is a flow chart of a drive method for a display device provided by another embodiment of the present application.

As shown in FIG. 3, in one embodiment of the present application, S10 includes:

S111: detecting whether a frequency of the drive signal is consistent with a frequency of a preset drive signal;

S112: determining that the spectrum of the drive signal is not spread if the frequency of the drive signal is consistent with the frequency of the preset drive signal; and S113: determining that the spectrum of the drive signal is spread if the frequency of the drive signal is not consistent with the frequency of the preset drive signal.

In application, the preset drive signal refer to a normal drive signal output from the control module with a spectrum not spread, and when the normal drive signal is used to drive the display panel, an abnormal display picture would not be caused.

Figure 4:
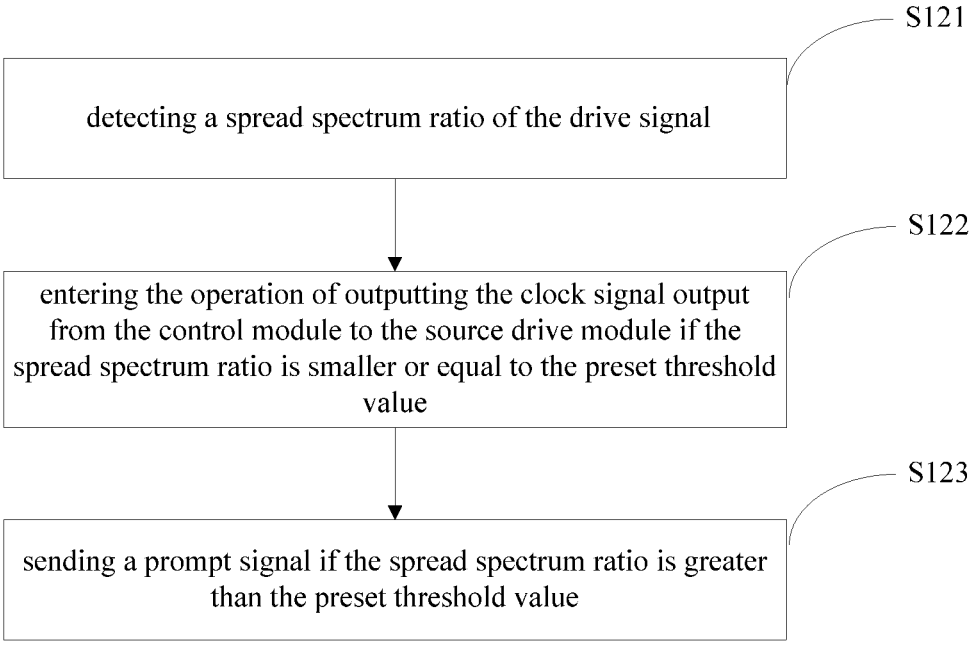
FIG. 4 is a flow chart of a drive method for a display device provided by still another embodiment of the present application.

As shown in FIG. 4, in one embodiment of the present application, before S20, the drive method further includes:

S121: detecting a spread spectrum ratio of the drive signal;

S122: entering the operation of outputting the clock signal output from the control module to the source drive module if the spread spectrum ratio is smaller or equal to the preset threshold value; and S123: sending a prompt signal if the spread spectrum ratio is greater than the preset threshold value.

In application, the spread spectrum ratio of the drive signal refer to a ratio of a maximum variation of the frequency of the drive signal relative to an original frequency of the normal drive signal to the original frequency.

In application, the preset threshold value ranges between 2% and 5%, for example, may be 2%, 3%, 4%, or 5%.

In application, whether the spectrum of the drive signal can be determined by means of detecting whether the drive signal is a variable frequency signal.

A drive method for a display device is also provided in one embodiment of the present application, and the drive method includes:

detecting whether a drive signal is a variable frequency signal when the drive signal is received, and the drive signal is configured to drive the display panel;

outputting a clock signal output from the control module to the source drive module if the drive signal is a constant frequency signal;

performing spectrum spread on the clock signal according to a preset spread spectrum ratio if the drive signal is a variable frequency signal; and outputting the clock signal with the spread spectrum to the source drive module.

In application, the constant frequency signal refer to a signal having a frequency of a certain regular and presenting periodical variation in the absence of obvious fluctuation.

Figure 5:
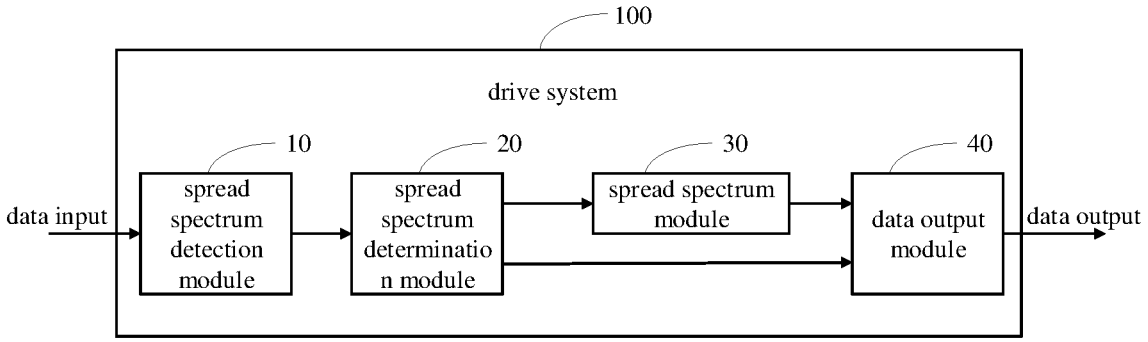
FIG. 5 is a structural schematic diagram of a drive system for a display device provided by one embodiment of the present application.

As shown in FIG. 5, a drive system 100 for a display device is provided in one embodiment of the present application, in order to execute steps of corresponding method embodiment of FIG. 1. The drive system 100 includes:

a spread spectrum detection module 10 configured to detect whether a spectrum of a drive signal is spread when the drive signal is received, and the drive signal is configured to drive the display panel;

a spread spectrum determination module 20 configured to output a clock signal output from the control module to the source drive module if the spectrum of the drive signal is spread;

a spread spectrum module 30 configured to perform spectrum spread on the clock signal according to a preset spread spectrum ratio if the spectrum of the drive signal is not spread; and a data output module 40 configured to output the clock signal with the spread spectrum to the source drive module.

In application, spread spectrum refer to convert a normal signal of a fixed frequency output from the control module into a variable frequency signal having a frequency positively and negatively fluctuating around the normal signal, thereby distributing an electromagnetic interference energy of the normal signal on the original frequency band to a frequency band adjacent to the original frequency band. Generally, the spread spectrum ratio adopts a ratio of a maximum variation of the original frequency of the variable frequency signal relative to the original frequency of the normal frequency to the original frequency as a measurement unit. The larger the spread spectrum ratio is, the larger the frequency variation is. Generally, the spread spectrum ratio cannot exceed a certain threshold value, or otherwise, the source drive module may be unable to normally receive the clock signal and the drive signal, resulting in abnormal display picture.

In application, the drive system can be a software system in the control module of the display device, and each module in the drive system can be a program module of the software system.

In application, the determination whether the spectrum of the drive signal is spread can be realized by means of detecting whether the drive signal is the variable frequency signal, or by means of detecting whether the variation rate of the frequency of the drive signal relative to a frequency of a preset normal drive signal is greater than the preset threshold value, if yes, then the spectrum of the drive signal is spread. The preset threshold value ranges between 2% and 5%, for example, may be 2%, 3%, 4%, or 5%.

In one embodiment, the preset spread spectrum ratio can be any value ranged between 2% and 5%, for example, may be 2%, 3%, 4%, or 5%.

In this embodiment, it is detected whether the spectrum of the drive signal is spread when the drive signal is received; if yes, the clock signal output from the control module is output to the source drive module; if no, the spectrum of the clock signal is spread according to the preset spread spectrum ratio and then output to the source drive module, thus, the electromagnetic interference of the display device can be effectively reduced, as well as the normal display picture of the display panel can be ensured.

Figure 6:
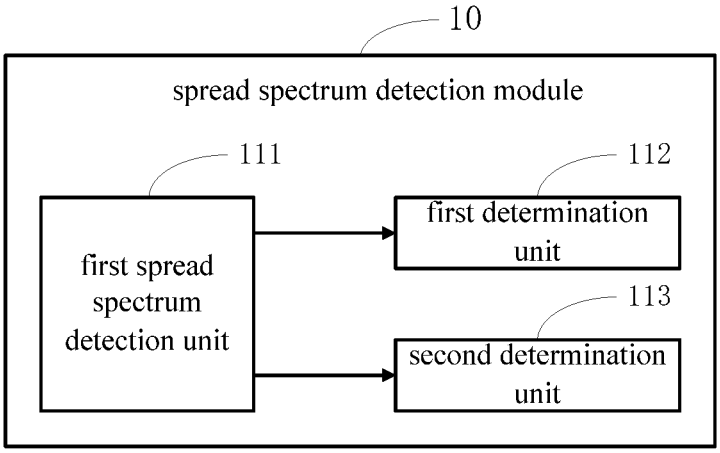
FIG. 6 is a structural schematic diagram of a drive system for a display device provided by another embodiment of the present application.

As shown in FIG. 6, in one embodiment of the present application, the spread spectrum detection module 10 includes structures configured to execute steps of the method embodiment corresponding to FIG. 3, which include:

a first spread spectrum detection unit 111, configured to detect whether a frequency of the drive signal is consistent with a frequency of a preset drive signal;

a first determination unit 112, configured to determine that the spectrum of the drive signal is not spread if the frequency of the drive signal is consistent with the frequency of the preset drive signal; and a second determination unit 113, configured to determine that the spectrum of the drive signal is spread if the frequency of the drive signal is not consistent with the frequency of the preset drive signal.

In application, the preset drive signal refers to a normal drive signal output from the control module with a spectrum not spread, and when the normal drive signal is used to drive the display panel, an abnormal display picture would not be caused.

In application, the preset drive signal refers to a normal drive signal output from the control module with a spectrum not spread, and when the normal drive signal is used to drive the display panel, an abnormal display picture would not be caused.

Figure 7:
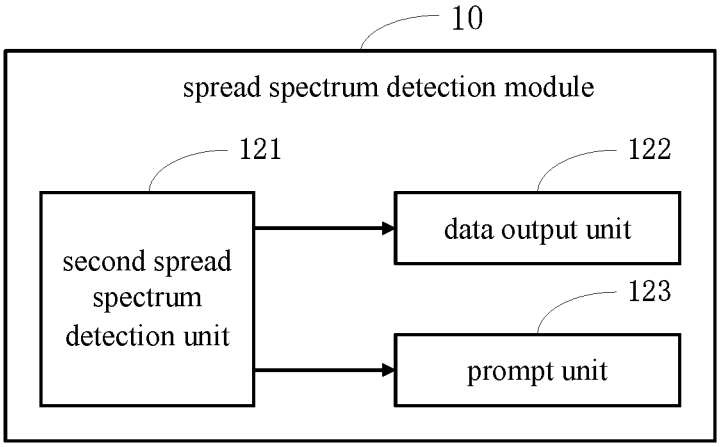
FIG. 7 is a structural schematic diagram of a drive system for a display device provided by one embodiment of the present application.

As shown in FIG. 7, in one embodiment of the present application, the spread spectrum detection module 10 includes structures configured to execute steps of the method embodiment corresponding to FIG. 4, which include:

a second spread spectrum detection unit 121, configured to detect a spread spectrum ratio of the drive signal;

a data output unit 122, configured to enter the operation of outputting the clock signal output from the control module to the source drive module if the spread spectrum ratio is smaller or equal to the preset threshold value;

a prompt unit 123, configured to send a prompt signal if the spread spectrum ratio is greater than the preset threshold value.

In application, the spread spectrum ratio of the drive signal refer to a ratio of a maximum variation of the frequency of the drive signal relative to an original frequency of the normal drive signal to the original frequency.

In application, the preset threshold value ranges between 2% and 5%, for example, may be 2%, 3%, 4%, or 5%.

In one embodiment, the spread spectrum detection module includes:

a third spread spectrum detection unit, configured to detect whether the drive signal is a variable frequency signal;

a third determination unit, configured to determine the spectrum of the drive signal is not spread if the drive signal is a constant frequency signal; and a fourth determination unit, configured to determine the spectrum of the drive signal is spread if the drive signal is a variable frequency signal.

A drive system for a display device is further provided by one embodiment of the present application. The drive method includes:

a spread spectrum detection module, configured to detect whether a drive signal is a variable frequency signal when the drive signal is received, and the drive signal is configured to drive the display panel;

a spread spectrum determination module, configured to output a clock signal output from the control module to the source drive module if the drive signal is a constant frequency signal;

a spread spectrum module, configured to perform spectrum spread on the clock signal according to a preset spread spectrum ratio if the drive signal is a variable frequency signal; and a data output module, configured to output the clock signal with the spread spectrum to the source drive module.

Figure 8:
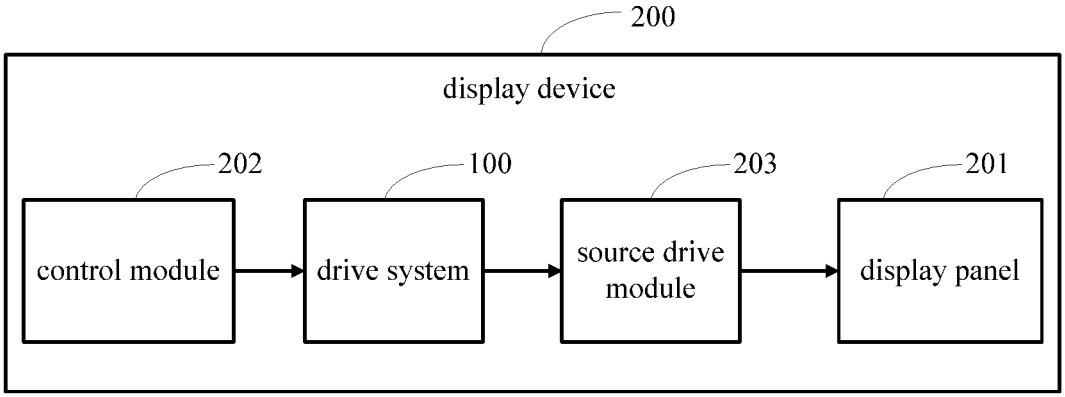
FIG. 8 is a structural schematic diagram of a display device provided by one embodiment of the present application.

As shown in FIG. 8, a display device 200 is provided by one embodiment of the present application and includes a display panel 201, a control module 202, a source drive module 203, and the drive system 100 in the above embodiments.

In application, the display panel may be any type of the display panel, for example, a crystal display panel based on TFT-LCD (thin film transistor liquid crystal display) technique, a crystal display panel based on LCD (liquid crystal display) technique, an electro luminescence display based on organic electro luminescence display technique, a quantum dot light emitting diode display panel based on QLED (quantum dot light emitting diode) technique, or a curved display panel.

The control module 202 is configured to output a clock signal.

In application, the control module may be a display drive board, and may also be implemented by integrated circuits, such as a central processing unit (CPU) or an application specific integrated circuit (ASIC).

The source drive module 203 is connected with the display panel 201 and the control module 202 and is configured to drive the display panel 201 according to the drive signal and the clock signal.

The drive system 100 is connected between the control module 202 and the source drive module 203.

The modules in all embodiments of the present application can be implemented by a universal integrated circuit such as a CPU (Central Processing Unit) or an ASIC (Application Specific Integrated Circuit).

Units in the device of the embodiments of the present application may be combined, divided, and deleted according to actual needs.

Steps in the method of the embodiment of the present application may be sequentially adjusted, combined, and deleted according to actual needs.

A person of ordinary skill in the art may understand that all or a part of the processes for implementing the methods in the foregoing embodiments may be implemented by a computer program instructing relevant hardware. The program may be stored in a computer-readable storage medium. When being executed, the program may include the flow of the embodiments of the above methods. The storage medium may be a magnetic disk, an optical disk, an ROM (read-only memory), am RAM (random access memory), or the like.

The above is only optional embodiments of the present application and is not intended to limit the present application. Any modifications, equivalent replacements, and improvements made within the spirit and principle of the present application should be included within the protection scope of the present application.

What is claimed is:

1. A drive method for a display device, wherein the display device comprises a control module, a source drive module, and a display panel; and the drive method comprises:

detecting whether a spectrum of a drive signal is spread when the drive signal is received, and the drive signal is configured to drive the display panel;

outputting a clock signal output from the control module to the source drive module if the spectrum of the drive signal is spread;

performing spectrum spread on the clock signal according to a preset spread spectrum ratio if the spectrum of the drive signal is not spread; and outputting the clock signal with the spread spectrum to the source drive module;

wherein, the step of detecting whether the spectrum of the drive signal is spread comprises:

detecting whether a frequency of the drive signal is consistent with a frequency of a preset drive signal;

determining that the spectrum of the drive signal is not spread if the frequency of the drive signal is consistent with the frequency of the preset drive signal; and determining that the spectrum of the drive signal is spread if the frequency of the drive signal is not consistent with the frequency of the preset drive signal.

2. The drive method of claim 1, wherein the preset spread spectrum ratio ranges between 2% and 5%.

3. The drive method of claim 1, wherein the step of detecting whether the frequency of the drive signal is consistent with the frequency of the preset drive signal comprises:

detecting whether a variation rate of the frequency of the drive signal relative to the frequency of the preset drive signal is greater than a preset threshold value;

determining that the drive signal is not consistent with the frequency of the preset drive signal if the variation rate is greater than the preset threshold value; and determining that the drive signal is consistent with the frequency of the preset drive signal if the variation rate is smaller than or equal to the preset threshold value.

4. The drive method of claim 3, wherein the preset threshold value ranges between 2% and 5%.

5. The drive method of claim 1, before outputting the clock signal output from the control module to the source drive module, further comprising:

detecting a spread spectrum ratio of the drive signal;

entering the operation of outputting the clock signal output from the control module to the source drive module if the spread spectrum ratio is smaller or equal to the preset threshold value; and sending a prompt signal if the spread spectrum ratio is greater than the preset threshold value.

6. The drive method of claim 5, wherein the preset threshold value ranges between 2% and 5%.

7. The drive method of claim 1, wherein the step of detecting whether the spectrum of the drive signal is spread comprises:

detecting whether the drive signal is a variable frequency signal;

determining the spectrum of the drive signal is not spread if the drive signal is a constant frequency signal; and determining the spectrum of the drive signal is spread if the drive signal is a variable frequency signal.

8. The drive method of claim 1, wherein the control module is connected with the source drive module, the source drive module is connected with the display panel, the control module is a display drive board, the source drive module is a film source drive chip, and the display panel is any one selected from the group consisting of a thin film transistor liquid crystal display, an electro luminescence display, and a quantum dot light emitting diode display panel.

9. A drive system for a display device, wherein the display device comprises: a control module, a source drive module, and a display panel; and the drive system comprises:

a spread spectrum detection module, configured to detect whether a spectrum of a drive signal is spread when the drive signal is received, and the drive signal is configured to drive the display panel;

a spread spectrum determination module, configured to output a clock signal output from the control module to the source drive module if the spectrum of the drive signal is spread;

a spread spectrum module, configured to perform spectrum spread on the clock signal according to a preset spread spectrum ratio if the spectrum of the drive signal is not spread; and a data output module, configured to output the clock signal with the spread spectrum to the source drive module;

wherein the spread spectrum detection module comprises:

a first spread spectrum detection unit, configured to detect whether a frequency of the drive signal is consistent with a frequency of a preset drive signal;

a first determination unit, configured to determine that the spectrum of the drive signal is not spread if the frequency of the drive signal is consistent with the frequency of the preset drive signal; and a second determination unit, configured to determine that the spectrum of the drive signal is spread if the frequency of the drive signal is not consistent with the frequency of the preset drive signal.

10. The drive system of claim 9, wherein the preset spread spectrum ratio ranges between 2% and 5%.

11. The drive system of claim 9, wherein the first spread spectrum detection unit is configured to:

detect whether a variation rate of the frequency of the drive signal relative to the frequency of the preset drive signal is greater than a preset threshold value;

determine that the drive signal is not consistent with the frequency of the preset drive signal if the variation rate is greater than the preset threshold value; and determine that the drive signal is consistent with the frequency of the preset drive signal if the variation rate is smaller than or equal to the preset threshold value.

12. The drive system of claim 11, wherein the preset threshold value ranges between 2% and 5%.

13. The drive system of claim 9, wherein the spread spectrum detection module comprises:

a second spread spectrum detection unit, configured to detect a spread spectrum ratio of the drive signal;

a data output unit, configured to enter the operation of outputting the clock signal output from the control module to the source drive module if the spread spectrum ratio is smaller or equal to the preset threshold value;

a prompt unit, configured to send a prompt signal if the spread spectrum ratio is greater than the preset threshold value.

14. The drive system of claim 13, wherein the preset threshold value ranges between 2% and 5%.

15. The drive system of claim 9, wherein the spread spectrum detection module comprises:

a third spread spectrum detection unit, configured to detect whether the drive signal is a variable frequency signal;

a third determination unit, configured to determine the spectrum of the drive signal is not spread if the drive signal is a constant frequency signal; and a fourth determination unit, configured to determine the spectrum of the drive signal is spread if the drive signal is a variable frequency signal.

16. The drive system of claim 9, wherein the control module is connected with the source drive module, the source drive module is connected with the display panel, the control module is a display drive board, the source drive module is a film source drive chip, and the display panel is any one selected from the group consisting of a thin film transistor liquid crystal display, an electro luminescence display, and a quantum dot light emitting diode display panel.

17. A drive method for a display device, wherein the display device comprises: a control module, a source drive module, and a display panel; and the drive method comprises:

detecting whether a drive signal is a variable frequency signal when the drive signal is received, and the drive signal is configured to drive the display panel;

outputting a clock signal output from the control module to the source drive module if the drive signal is a constant frequency signal;

performing spectrum spread on the clock signal according to a preset spread spectrum ratio if the drive signal is a variable frequency signal; and outputting the clock signal with the spread spectrum to the source drive module.

18. The drive method of claim 17, wherein the control module is connected with the source drive module, the source drive module is connected with the display panel, the control module is a display drive board, the source drive module is a film source drive chip, the display panel is any one selected from the group consisting of a thin film transistor liquid crystal display, an electro luminescence display, and a quantum dot light emitting diode display panel.

* * * * *